US010281187B2

(12) United States Patent
Junge et al.

(10) Patent No.: US 10,281,187 B2
(45) Date of Patent: May 7, 2019

(54) ICE MAKING METHOD AND SYSTEM FOR REFRIGERATOR APPLIANCE

(71) Applicant: Haier US Appliance Solutions, Inc., Wilmington, DE (US)

(72) Inventors: Brent Alden Junge, Evansville, IN (US); Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/355,172

(22) Filed: Nov. 18, 2016

(65) Prior Publication Data

US 2018/0142934 A1 May 24, 2018

(51) Int. Cl.

| | |
|---|---|
| ***F25C 1/04*** | (2018.01) |
| ***F25C 5/08*** | (2006.01) |
| ***F25C 5/187*** | (2018.01) |
| ***F25D 17/06*** | (2006.01) |

(52) U.S. Cl.

CPC ..... *F25C 5/08* (2013.01); *F25C 5/187* (2013.01); *F25D 17/065* (2013.01); *F25B 2700/02* (2013.01); *F25C 2600/02* (2013.01); *F25C 2600/04* (2013.01); *F25C 2700/12* (2013.01); *F25D 2317/061* (2013.01); *F25D 2317/062* (2013.01); *F25D 2700/02* (2013.01)

(58) Field of Classification Search

CPC .... F25C 5/08; F25C 5/182; F25C 1/04; F25C 2500/06; F25C 2400/10; F25C 2700/12; F25D 11/00

See application file for complete search history.

(56) References Cited

U.S. PATENT DOCUMENTS

| | | | | |
|---|---|---|---|---|
| 5,501,081 | A * | 3/1996 | Mori | F25C 1/147 62/135 |
| 7,392,665 | B2 | 7/2008 | Lee et al. | |
| 7,703,292 | B2 | 4/2010 | Cook et al. | |
| 8,794,014 | B2 | 8/2014 | Kulkarni et al. | |
| 9,175,893 | B2 | 11/2015 | Junge et al. | |
| 9,200,828 | B2 | 12/2015 | Mitchell et al. | |
| 9,303,913 | B2 | 4/2016 | Ha | |
| 2006/0086130 | A1 * | 4/2006 | Anselmino | F25C 5/22 62/344 |
| 2008/0092574 | A1 * | 4/2008 | Doberstein | F25C 1/04 62/233 |
| 2008/0196429 | A1 | 8/2008 | Petrenko et al. | |
| 2009/0223230 | A1 * | 9/2009 | Kim | F25C 1/08 62/73 |
| 2014/0150487 | A1 | 6/2014 | Boarman | |

* cited by examiner

*Primary Examiner* — Kun Kai Ma
(74) *Attorney, Agent, or Firm* — Dority & Manning, P.A.

(57) ABSTRACT

A refrigerator appliance includes a cabinet defining a fresh food chamber and a freezer chamber below the fresh food chamber. The refrigerator appliance further includes an ice maker disposed within the cabinet outside of the freezer chamber and proximate to the fresh food chamber. The ice maker is in thermal communication with a freezer evaporator via a fan, a supply duct, and a return duct. The ice maker includes a harvest heater and the freezer evaporator is deactivated while the harvest heater is active.

11 Claims, 7 Drawing Sheets

ICE MAKING METHOD AND SYSTEM FOR REFRIGERATOR APPLIANCE

FIELD OF THE INVENTION

The present subject matter relates generally to refrigeration appliances, and more particularly to refrigeration appliances including features for making ice.

BACKGROUND OF THE INVENTION

Generally, refrigerator appliances include a cabinet that defines a fresh food chamber for receipt of food items for storage. Many refrigerator appliances further include a freezer chamber for receipt of food items for freezing and storage. Certain refrigerator appliances include an ice maker. In order to produce ice, liquid water is directed to the ice maker and frozen. Accordingly, refrigerator appliances having both an ice maker and a freezer chamber commonly include the ice maker in the freezer chamber since both operate at or around the same general temperatures. However, in many currently utilized refrigerator appliances, the freezer chamber is positioned below the fresh food chamber, which is sometimes referred to as a bottom freezer. In such refrigerator appliances, locating the ice maker in the bottom freezer may be inconvenient or otherwise not desired.

Accordingly, methods and systems for ice making in a refrigerator appliance with features permitting operation remote from the freezer chamber would be useful.

BRIEF DESCRIPTION OF THE INVENTION

A refrigerator appliance includes a cabinet defining a fresh food chamber and a freezer chamber below the fresh food chamber. The refrigerator appliance further includes an ice maker disposed within the cabinet outside of the freezer chamber and proximate to the fresh food chamber. The ice maker is in thermal communication with a freezer evaporator via a fan, a supply duct, and a return duct. The ice maker includes a harvest heater and the freezer evaporator is deactivated while the harvest heater is active. Additional aspects and advantages of the invention will be set forth in part in the following description, or may be apparent from the description, or may be learned through practice of the invention.

In accordance with one embodiment, a method of defrosting an icemaker disposed in a sealed compartment of a refrigerator appliance is provided. The refrigerator appliance includes a cabinet defining a fresh food chamber and a freezer chamber, the freezer chamber positioned below the fresh food chamber along a vertical direction, the icemaker including a mold body and a heat exchanger, the heat exchanger extending through the sealed compartment and in thermal communication with the mold body, the sealed compartment disposed outside of the freezer chamber and proximate to the fresh food chamber. The method includes actuating a valve connected to a water supply line to fill the mold body with liquid water, activating a fan to flow cold air to the heat exchanger from a freezer evaporator positioned proximate the freezer chamber, activating a harvest heater to heat the mold body, and deactivating the freezer evaporator while the harvest heater is active, such that the fan flows warm air to the heat exchanger.

In accordance with another embodiment, a method of defrosting an icemaker disposed in a sealed compartment is provided. The icemaker includes a mold body and a heat exchanger extending through the sealed compartment and the heat exchanger is in thermal communication with the mold body. The method includes actuating a valve connected to a water supply line to fill the mold body with liquid water, activating a fan to flow cold air from a cold air source outside the sealed compartment to the heat exchanger, activating a harvest heater to heat the mold body, and deactivating the cold air source while the harvest heater is active, such that the fan flows warm air to the heat exchanger.

In accordance with another embodiment, a refrigerator appliance is provided. The refrigerator appliance includes a cabinet defining a fresh food chamber and a freezer chamber, the freezer chamber positioned below the fresh food chamber along a vertical direction, the cabinet also includes a sealed icebox compartment outside of the freezer chamber and proximate to the fresh food chamber. The sealed icebox compartment further includes a heat exchange opening. The refrigerator appliance also includes an ice maker disposed within the sealed icebox compartment, the ice maker including a mold body and a heat exchanger, the heat exchanger extends through the sealed icebox compartment at the heat exchange opening and the heat exchanger is in thermal communication with the mold body. The refrigerator appliance also includes a controller configured to actuate a valve connected to a water supply line to fill the mold body with liquid water, activate a fan to flow cold air to the heat exchanger from a freezer evaporator positioned proximate the freezer chamber, activate a harvest heater to heat the mold body, and deactivate the freezer evaporator while the harvest heater is active, such that the fan will flow warm air to the heat exchanger.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
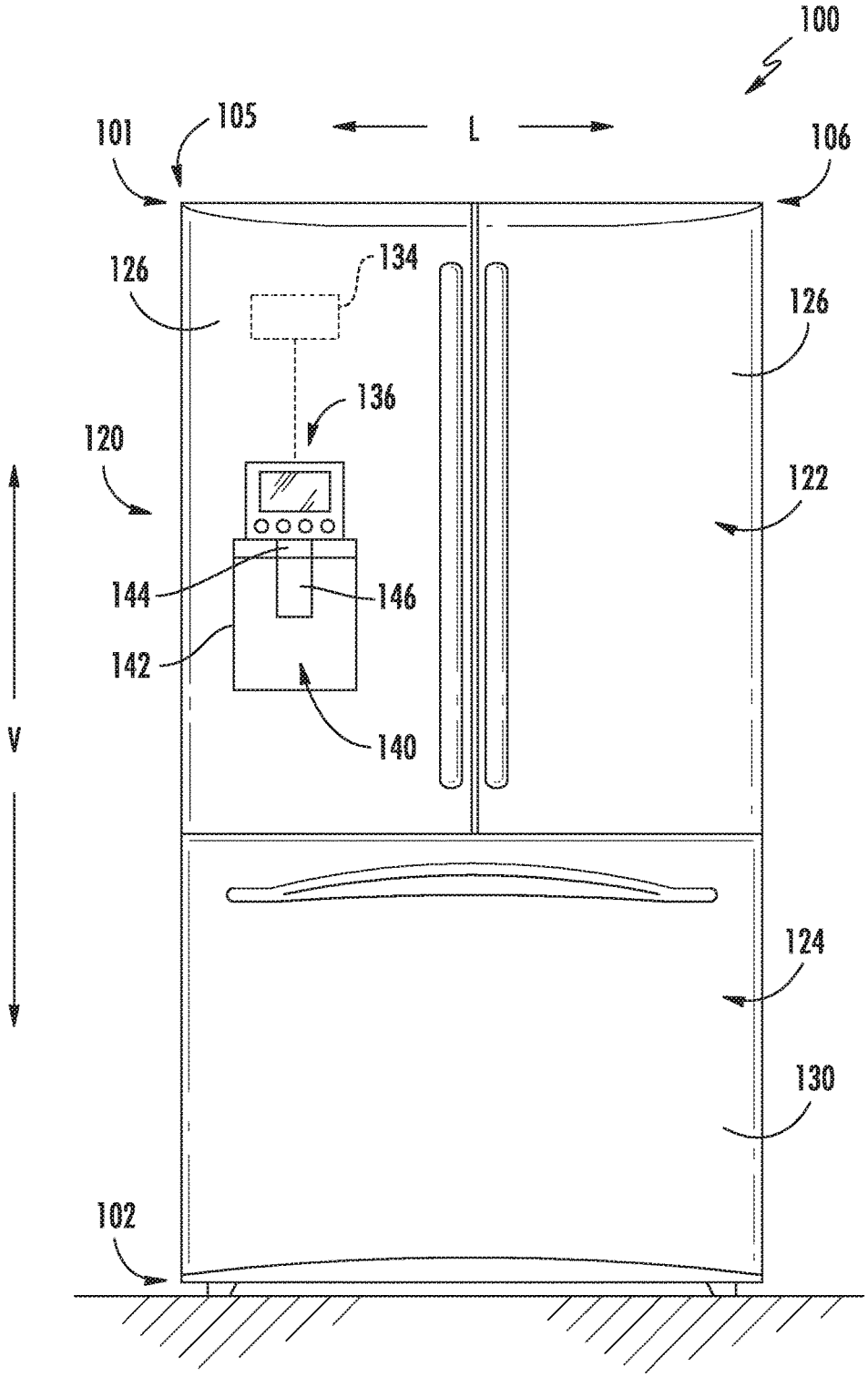
FIG. 1 provides a front elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation such as "about" are considered as including within ten percent more or less than a stated value. For example, "about one hundred" may include as little as ninety percent of the stated value and/or as much as one hundred and ten percent of the stated value.

FIG. 1 is a front view of an exemplary embodiment of a refrigerator appliance 100. Refrigerator appliance 100 extends between a top portion 101 and a bottom portion 102 along a vertical direction V. Refrigerator appliance 100 also extends between a first side portion 105 and a second side portion 106 along a lateral direction L. A transverse direction T (FIG. 2) may additionally be defined perpendicular to the vertical and lateral directions V, L.

Refrigerator appliance 100 includes a cabinet or housing 120 defining an upper fresh food chamber 122 and a lower freezer chamber 124 arranged below the fresh food chamber 122 on the vertical direction V. As such, refrigerator appliance 100 is generally referred to as a "bottom mount refrigerator." In the exemplary embodiment, housing 120 also defines a mechanical compartment 12 (FIG. 4) for receipt of a sealed cooling system 10. Using the teachings disclosed herein, one of skill in the art will understand that the present invention can be used with other types of refrigerators (e.g., side-by-sides) or any other types of appliance as well. Consequently, the description set forth herein is for illustrative purposes only and is not intended to limit the invention in any aspect.

Refrigerator doors 126 are rotatably hinged to an edge of housing 120 for accessing fresh food chamber 122. It should be noted that while two doors 126 in a "French door" configuration are illustrated, any suitable arrangement of doors utilizing one, two or more doors is within the scope and spirit of the present disclosure. A freezer door 130 is arranged below refrigerator doors 126 for accessing freezer chamber 124. In the exemplary embodiment, freezer door 130 is coupled to a freezer drawer (not shown) slidably coupled within freezer chamber 124.

Operation of the refrigerator appliance 100 can be regulated by a controller 134 that is operatively coupled to a user interface panel 136. Panel 136 provides selections for user manipulation of the operation of refrigerator appliance 100 such as e.g., temperature selections, etc. In response to user manipulation of the user interface panel 136, the controller 134 operates various components of the refrigerator appliance 100. The controller may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In some embodiments, the processor executes programming instructions stored in memory. The memory may be a separate component from the processor or may be included onboard within the processor.

The controller 134 may be positioned in a variety of locations throughout refrigerator appliance 100. In the illustrated embodiment, the controller 134 may be located within the door 126. In such an embodiment, input/output ("I/O") signals may be routed between the controller and various operational components of refrigerator appliance 100. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller via one or more signal lines or shared communication busses.

Figure 5:
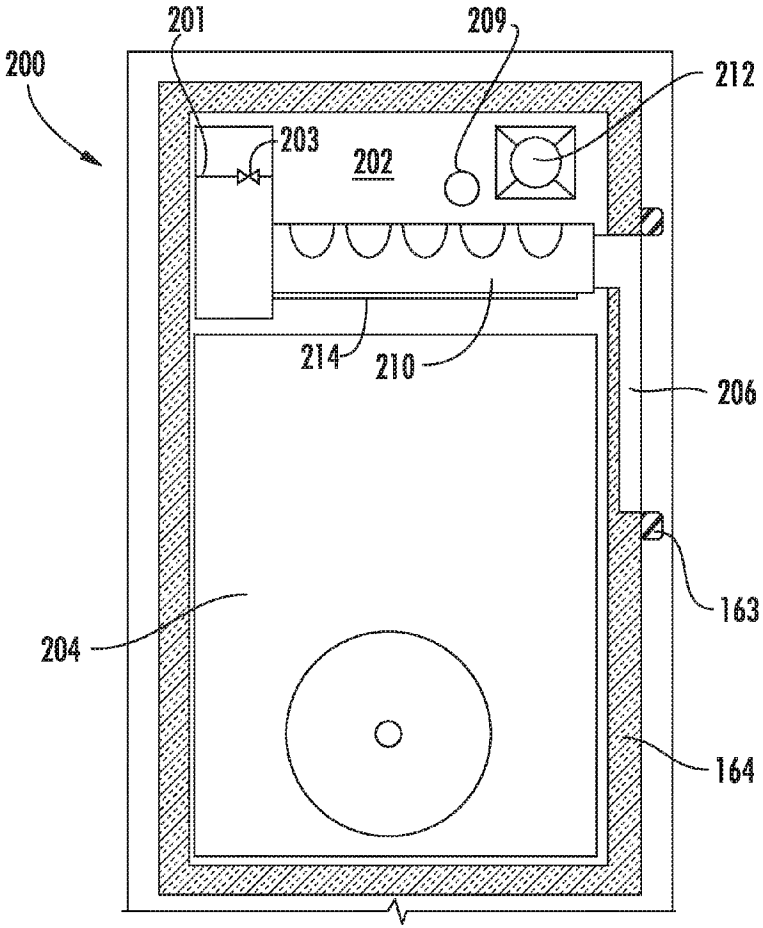
FIG. 5 provides a partial section view of the ice making system of FIG. 3.

The controller 134 may be in operative communication with one or more sensors. For example, the refrigerator appliance 100 may include an external humidity sensor 156 (FIG. 3) for sensing a humidity of an ambient environment outside of the refrigerator appliance 100 and/or a temperature sensor 209 (FIG. 5) proximate to the mold body 210. As illustrated in FIG. 5, the exemplary temperature sensor 209 may be disposed proximate to, but not directly on, the mold body 210. In some exemplary embodiments, the temperature sensor 209 may be a thermistor in contact with the mold body 210.

In some exemplary embodiments, the door 126, which is rotatably hinged to the cabinet 120 at the fresh food chamber 122, as discussed above, may include an inner surface 150, and a switch 154 may be provided, positioned such that the inner surface 150 of the door 126 engages the switch 154 when the door 126 is in a closed position. In the exemplary embodiment illustrated in FIG. 3, switch 154 is positioned on cabinet 120, in alternative embodiments, switch 154 may be disposed on the door 126. In some exemplary embodiments, the switch 154 may be a light switch configured to activate a refrigerator light when the door 126 opens, as is understood in the art. The controller 134 may be in communication with the switch 154 to determine a status of door 126 based on the switch 154 condition. For example, the controller 134 may be configured to sense when switch 154 is actuated and thereby determine that the door 126 has been opened. In some embodiments, controller 134 may also track the number of times door 126 has been opened, for example, controller 134 may track the number of times door 126 has been opened since the harvest heater 214 was last activated.

It should be noted that controllers 134 as disclosed herein are capable of and may be operable to perform any methods and associated method steps as disclosed herein.

Figure 2:
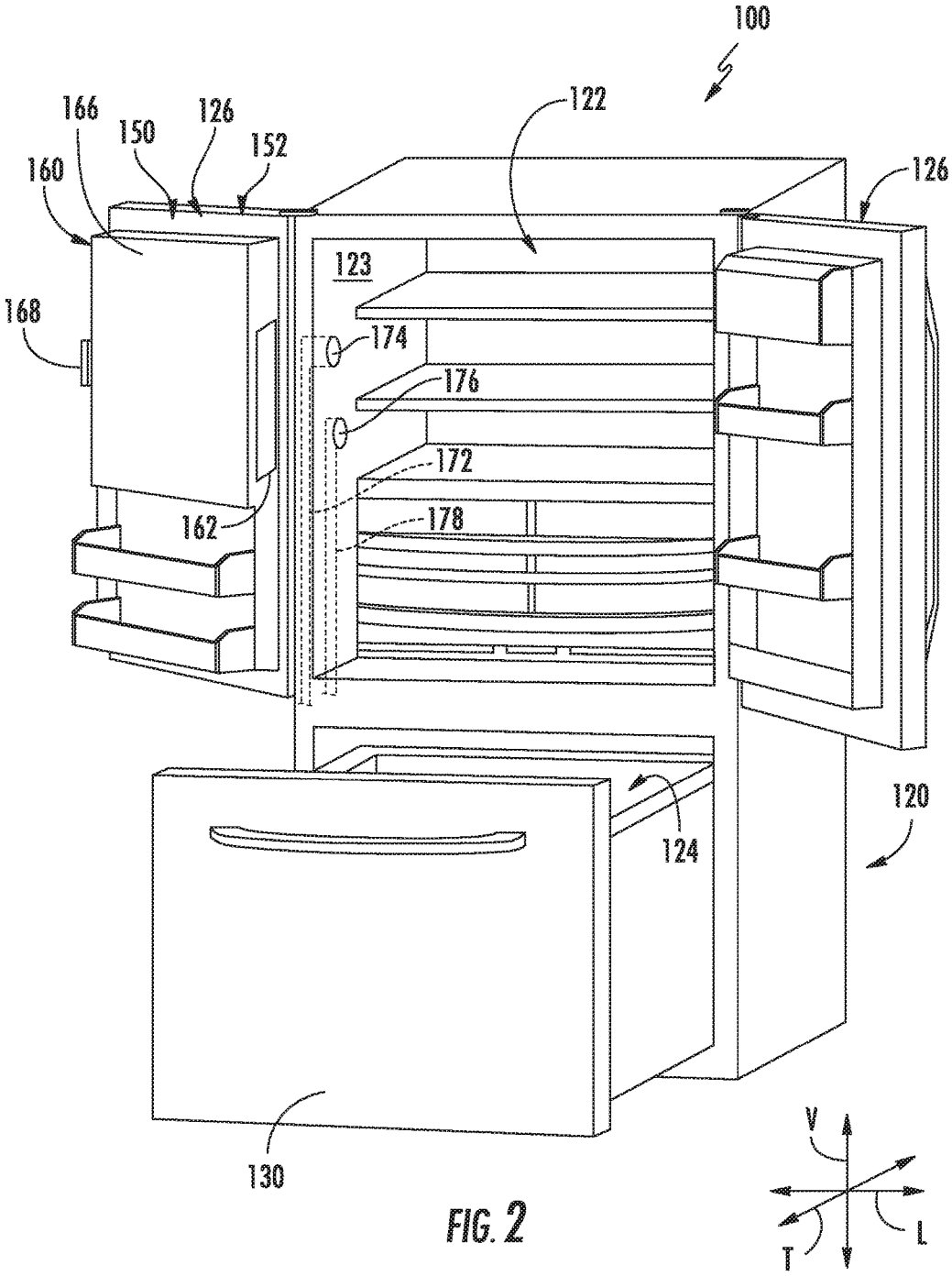
FIG. 2 provides a front perspective view of the exemplary refrigerator appliance of FIG. 1 with refrigerator doors of the refrigerator appliance shown in an open configuration to reveal a fresh food chamber and freezer chamber of the refrigerator appliance.

FIG. 2 is a perspective view of refrigerator appliance 100 having refrigerator doors 126 in an open position to reveal the interior of the fresh food chamber 122. Additionally, freezer door 130 is shown in an open position to reveal the interior of the freezer chamber 124.

Figure 3:
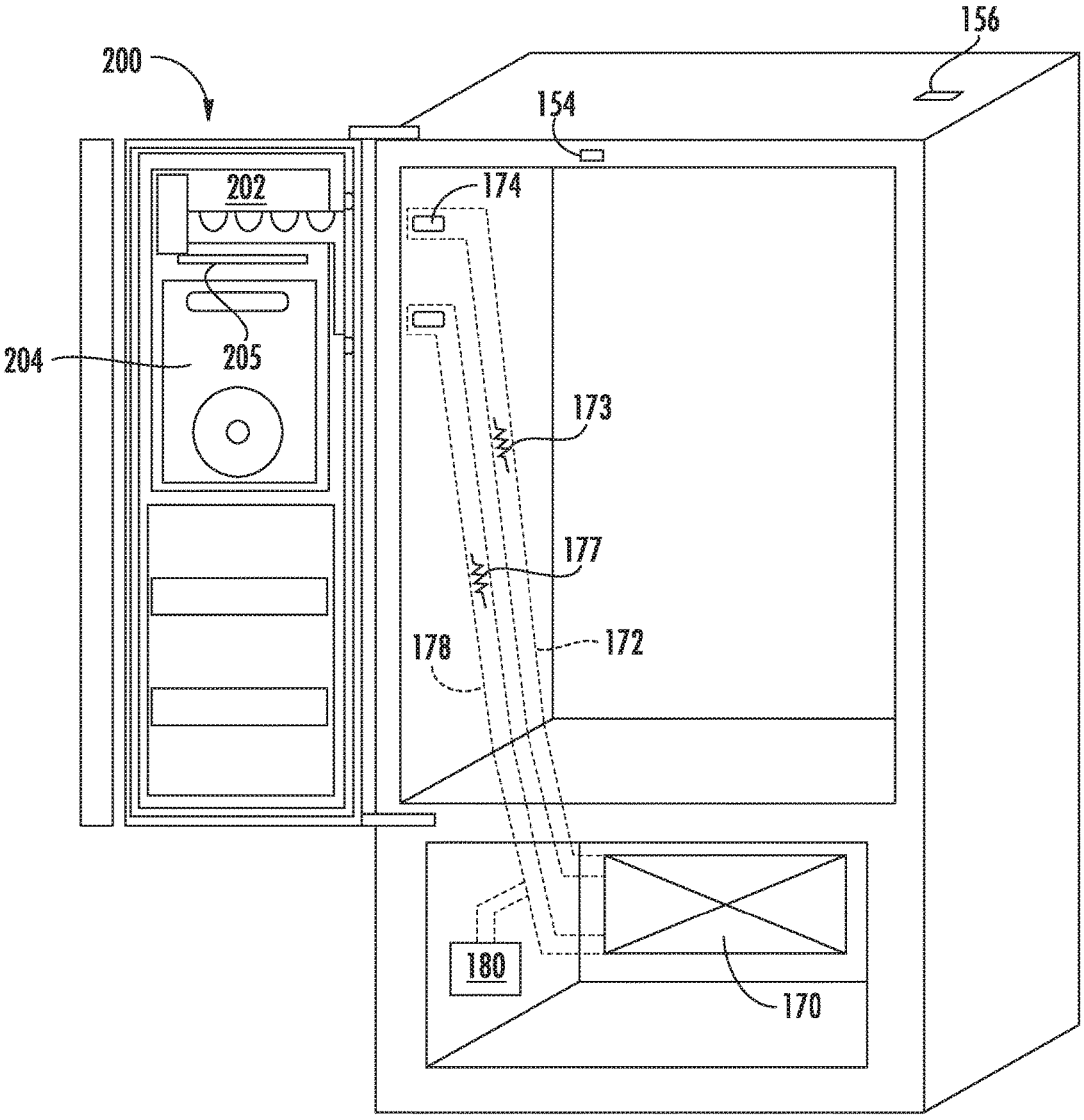
FIG. 3 provides a partial schematic view of an ice making system in a refrigerator door of the exemplary refrigerator appliance of FIG. 1 according to an exemplary embodiment of the present subject matter.

Referring now to FIGS. 2 and 3, a door 126 of the refrigerator appliance 100 may include an inner surface 150 and an outer surface 152. The inner surface 150 generally defines the interior of the fresh food chamber 122 when the door 126 is in a closed position as shown in FIG. 1, while the outer surface 152 is generally opposite the inner surface 150 and defines the exterior of the refrigerator appliance 100.

As shown for example in FIG. 3, an ice making system 200 may be provided outside of the freezer chamber 124 and proximate to the fresh food chamber 122, e.g., in one of the doors 126, such as disposed in a compartment 160, which may be referred to as an icebox compartment 160, defined at the inner surface 150 of one of the doors 126. In such embodiments, the ice making system 200 may be disposed at least partially within the fresh food chamber 122 when the door 126 is in the closed position. Ice making system 200 may include an ice making chamber 202 where ice may be formed in a mold body 210. Ice making system 200 may also include an ice storage bin 204 disposed in communication with the mold body 210, e.g., below mold body 210, for receipt and storage of ice once the ice has been formed in mold body 210. In some exemplary embodiments, a level sensor 205 may be provided, e.g., as illustrated in FIG. 3, proximate to a top portion of the ice storage bin 204 to sense whether or not a level of ice stored in the ice storage bin 204 is at a full level or a maximum fill level of the ice storage bin 204. In various exemplary embodiments, the level sensor 205 may be an optical sensor, a sweep arm as illustrated in FIG. 3, or any other suitable mechanism for sensing the level of ice stored in the ice storage bin 204.

Figure 4:
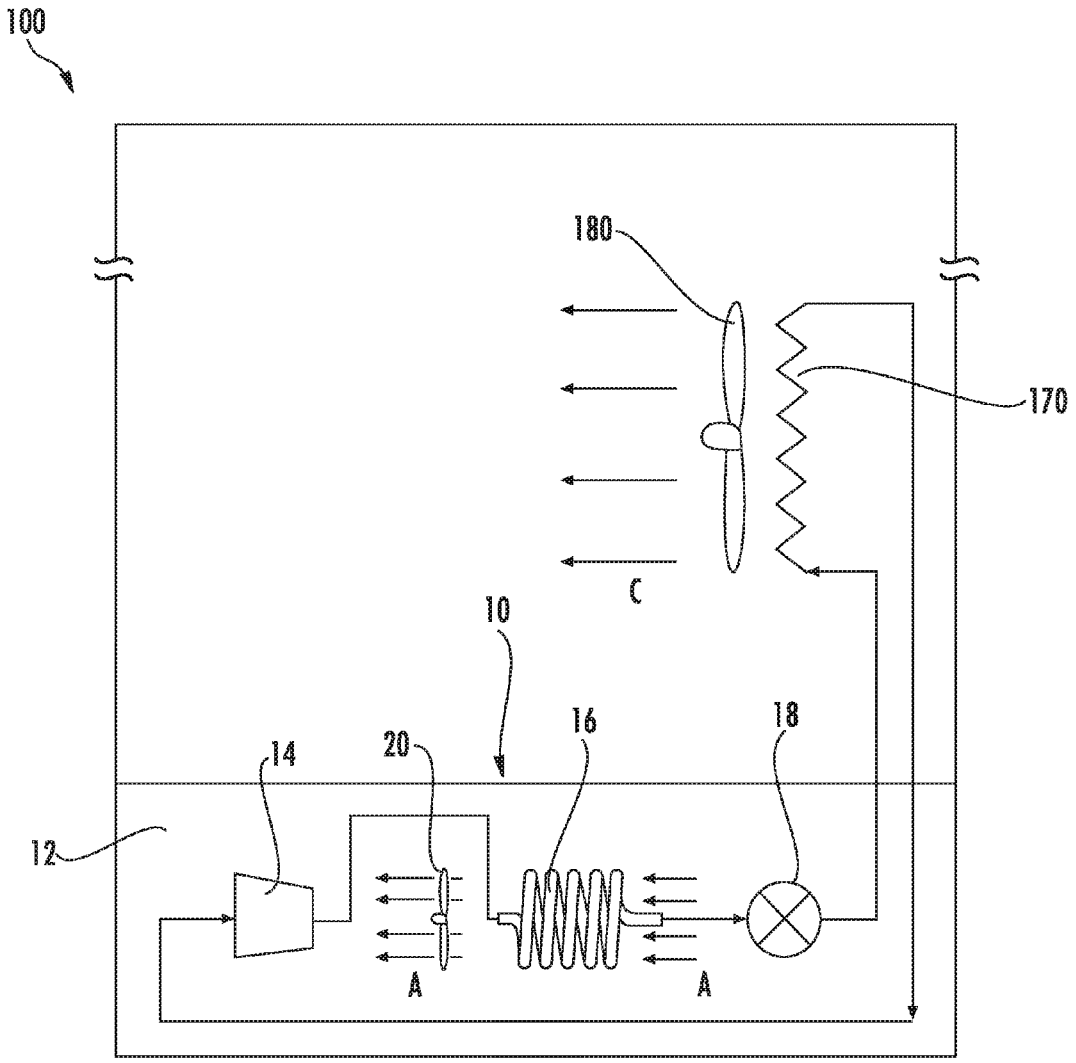
FIG. 4 is a schematic illustration providing an example of a refrigeration cycle as may be used with one or more embodiments of the present subject matter.

FIG. 4 is a schematic view of refrigerator 100 including an exemplary sealed cooling system 10. In some exemplary embodiments, refrigerator 100 may include a machinery compartment 12 that at least partially contains components for executing a known vapor compression cycle for cooling air. The components include a compressor 14, a heat exchanger or condenser 16, an expansion device 18, and an evaporator 170 connected in series and charged with a refrigerant. Evaporator 170 is also a type of heat exchanger which transfers heat from air passing over the evaporator to a refrigerant flowing through evaporator 170 thereby causing the refrigerant to vaporize. As such, cooled air C is produced and configured to refrigerate compartments 122, 124 of refrigerator 100. Further, cooled air C may be supplied to heat exchanger 206, as described herein.

From evaporator 170, vaporized refrigerant flows to compressor 14, which operates to increase the pressure of the refrigerant. This compression of the refrigerant raises its temperature, which is lowered by passing the gaseous refrigerant through condenser 16 where heat exchange with ambient air takes place so as to cool the refrigerant. A fan 20 is used to pull air across condenser 16, as illustrated by arrows A, so as to provide forced convection for a more rapid and efficient heat exchange between the refrigerant and the ambient air.

As described above, the refrigerator appliance 100 may include a sealed cooling system 10, and the sealed cooling system may include a freezer evaporator 170 which produces cold air C, e.g., air at a temperature suitable for storing frozen foods within freezer chamber 124. The general principles of operation of such sealed cooling systems are understood by those of ordinary skill in the art and are not discussed in greater detail herein. Also as would be understood by one of ordinary skill in the art, the temperature of the cold air produced by the sealed cooling system, and in particular by the freezer evaporator 170 for cooling freezer chamber 124 may be varied as desired by the operator, e.g., by setting a temperature or temperature range via user interface 136. Thus, as used herein, "cold" air is considered to include air with a suitable temperature for storing frozen foods, as is understood in the art, whereas "warm" air is considered to include air at higher temperatures than "cold" air, for example, room temperature or within a temperature range as may be provided to fresh food chamber 122.

The ice making system 200 may, as discussed herein, be in thermal communication with freezer evaporator 170. In some exemplary embodiments, the ice making chamber 202 may not be in fluid communication with the freezer evaporator 170. In other words, in such embodiments, the ice making chamber 202 may be isolated from the freezer evaporator 170. For example, in such embodiments, thermal communication between ice making system 200 and freezer evaporator 170 may be by convection, i.e., air flow, from evaporator 170 to a heat exchanger 206 and by conduction from heat exchanger 206 to the mold body 210 in the ice making chamber 202. Providing cold air C (FIG. 4) from the evaporator 170 to heat exchanger 206 rather than into ice making chamber 202 may permit more efficient thermal energy transfer from the cold air C to the ice maker mold body 210. That is, rather than circulating cold air C above the mold body 210, impinging a flow of cold air C on the heat exchanger 206 which is in direct conductive thermal communication with the mold body 210 allows the cold air C to more directly influence the mold body 210. As a result, the ice making system 200 may be more efficient and provide faster ice production.

In general, the ice making system 200 and various components thereof, may be provided with insulation 164 (FIG. 5) to reduce heat exchange between the ice making system 200 and the fresh food chamber 122 as well as between ice making system 200 and the ambient environment, e.g., such that the temperature within ice making chamber 202 and ice storage bin 204 can be maintained at levels different from, e.g., cooler than, the temperature in the fresh food chamber 122 and the ambient environment. The ice compartment 160 may include a heat exchange opening 162. The ice maker compartment 160 may be otherwise completely enclosed by insulation 164, except at the heat exchange opening 162. In exemplary embodiments, various features for providing access to ice stored in the ice storage bin may be provided. In one example, an insulated door may be provided in the compartment 160 for access to the ice storage bin. In other embodiments, the outer surface of door 126 may include a dispenser feature, as is generally understood by those skilled in the art, which extends through the insulation 164 on the opposite side of compartment 160 from the fresh food chamber 122 when door 126 is in the closed position.

Turning back to FIG. 1, in some exemplary embodiments, ice from storage bin 204 may be supplied to dispenser recess 140 on the outer surface 152 of refrigerator door 126. In such embodiments, refrigerator appliance 100 may include a dispenser assembly, e.g., for delivering or dispensing ice. Dispenser assembly may include a dispenser 142 positioned on or mounted to an exterior portion of refrigerator appliance 100, e.g., on one of refrigerator doors 126. Dispenser 142 may include a discharging outlet 144 for accessing ice. An actuating mechanism 146, shown as a paddle, may be mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. Discharging outlet 144 and actuating mechanism 146 may be external parts of dispenser 142 which may be mounted in a dispenser recess 140. Dispenser recess 140 may be positioned at a predetermined elevation convenient for a user to access ice or water and enabling the user to access ice without the need to bend over and without the need to open refrigerator doors 126. In some exemplary embodiments, dispenser recess 140 may be positioned at a level that approximates the chest level of a user.

In some exemplary embodiments, an access door, e.g., icebox door 166 (FIG. 2), may be hinged to icebox compartment 160 to selectively cover or permit access to opening of icebox compartment 160. In such embodiments, icebox door 166 permits selective access to icebox compartment 160. Any manner of suitable latch 168 may be provided with icebox compartment 160 to maintain icebox door 166 in a closed position. In some exemplary embodiments, latch 168 may be actuated by a consumer in order to open icebox door 166 for providing access into icebox compartment 160. In exemplary embodiments which include icebox door 166, insulation 164 is provided throughout icebox door 166 for thermally isolating or insulating icebox compartment 160 from fresh food chamber 122.

Figure 6:
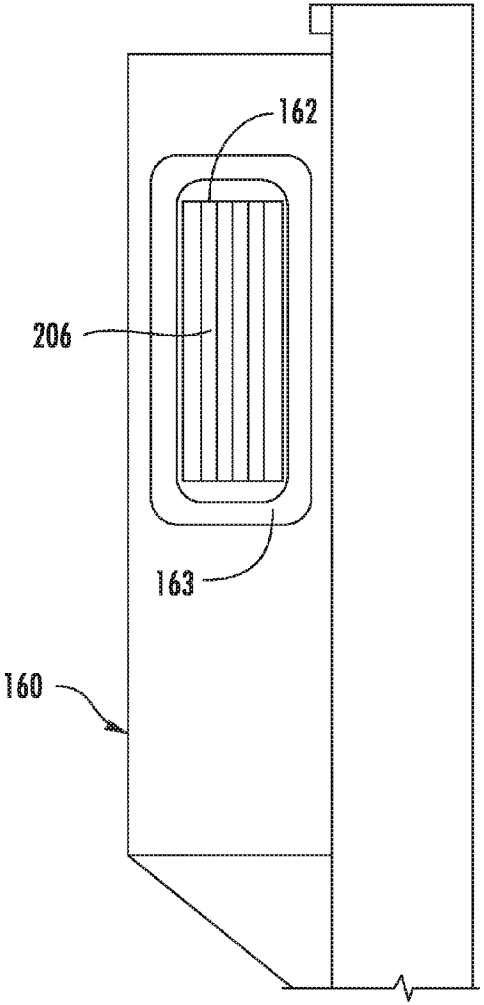
FIG. 6 provides a partial side view of the ice making system and the refrigerator door of FIG. 3.

In some embodiments, for example as illustrated in FIGS. 5 and 6, a gasket 163 may be provided at an outer surface of the icebox compartment 160. The gasket 163 may enclose heat exchange opening 162. When the door 126 is in a closed position, gasket 163 may sealingly engage a side wall 123 of the fresh food chamber 122 to prevent air leakage when the door 126 is in a closed position. For example, gasket 163 may help to prevent or minimize cold air flowing between supply duct 172 and return duct 178 from escaping into the fresh food chamber 122 and/or relatively warm, humid air from fresh food chamber 122 from entering return duct 178 or contacting heat exchanger 206. In alternative embodiments, gasket 163 may be positioned on side wall 123 of the fresh food chamber 122 and extend between side wall 123 and the outer surface of the icebox compartment 160 at heat exchange opening 162 when door 126 is in the closed position.

Although the gasket 163 prevents or limits relatively warmer and more humid air from fresh food chamber 122 or the ambient environment from contacting the heat exchanger 206 when the door 126 is in the closed position, when the door 126 is opened, condensation may gather on heat exchanger 206 which may lead to frost formation on heat exchanger 206. In such cases, because the cold air from the evaporator 170 tends to be relatively dry (i.e., low humidity), it may provide sublimation defrosting of the heat exchanger 206. That is, because the humidity of the air from the evaporator 170 is so low, some or all frost which may form on the heat exchanger 206 may evaporate when exposed to air from evaporator 170 passing over it. As such, any water which collects on the heat exchanger 206 in the form of condensation will travel at least partly as water vapor through ducts 172 and 178 rather than as liquid water, i.e., liquid water in ducts 172 and 178 is avoided or limited.

Various components may be utilized to facilitate the temperature variance between ice making system 200 and fresh food chamber 122. For example, in one embodiment, ice making system 200 may be in fluid communication with the freezer chamber 124. As shown, e.g., in FIGS. 2 and 3, in some embodiments, the ice making system 200 may be in fluid communication with evaporator 170 which may be disposed in or near the freezer chamber 124. In some embodiments, supply duct 172 and return duct 178 may extend between and provide the thermal communication between the ice making system 200 and freezer chamber 124. Such communication between evaporator 170 and ice making system 200 may be provided or enhanced by various air movers, such as a blower or fan 180, connected to one or the other of supply duct 172 and return duct 178. In some exemplary embodiments, fan 180 may be a centrifugal blower or fan. In particular, some exemplary embodiments of ducts 172 and 178 may induce a fairly large pressure drop and relatively low volume flow in the ducts 172 and 178. In such exemplary embodiments, a centrifugal blower or fan may advantageously be relatively efficient. In other exemplary embodiments, any other suitable fan 180 may be used, in particular in exemplary embodiments with different duct designs.

Supply duct 172 may include, for example, supply outlet 174 supplying cold air from freezer chamber 124 to an exterior portion of ice making system 200. Return duct 178 may include, for example, return inlet 176 flowing air from ice making system 200 to freezer chamber 124. Ducts 172 and 178 may generally be disposed within the refrigerator appliance 100, such as within the various walls defining the chambers 122, 124. In some exemplary embodiments, the ducts 172 and 178 may be foamed in place within the various walls of the refrigerator appliance 100. As illustrated in FIG. 3, in some exemplary embodiments, a heater 173 or 177 may be provided in one or both of supply duct 172 and return duct 178, e.g., a resistance heating element 173, 177 as illustrated.

In some exemplary embodiments, e.g., as shown in FIGS. 5 and 6, the heat exchanger 206 extends through the insulation 164 at the heat exchange opening 162. Therefore, in such exemplary embodiments, the heat exchanger 206 may be the only portion of the ice maker 200 not enclosed by the insulation 164. In such embodiments, the outlet 174 and inlet 176 are positioned on wall 123 such that the outlet 174 and inlet 176 correspond or align with the heat exchange opening 162 when the door 126 is in the closed position. More particularly, in such exemplary embodiments, the outlet 174 may be positioned such that when the door 126 is in the closed position, the outlet 174 is proximate to an upper portion of the heat exchanger 206 and is surrounded by the gasket 163, while the inlet 176 of return conduit 178 may be positioned below the outlet 174 of the supply conduit 172 such that when the door 126 is in the closed position the inlet 176 is proximate to a lower portion of the heat exchanger 206 and is surrounded by the gasket 163.

Figure 7:
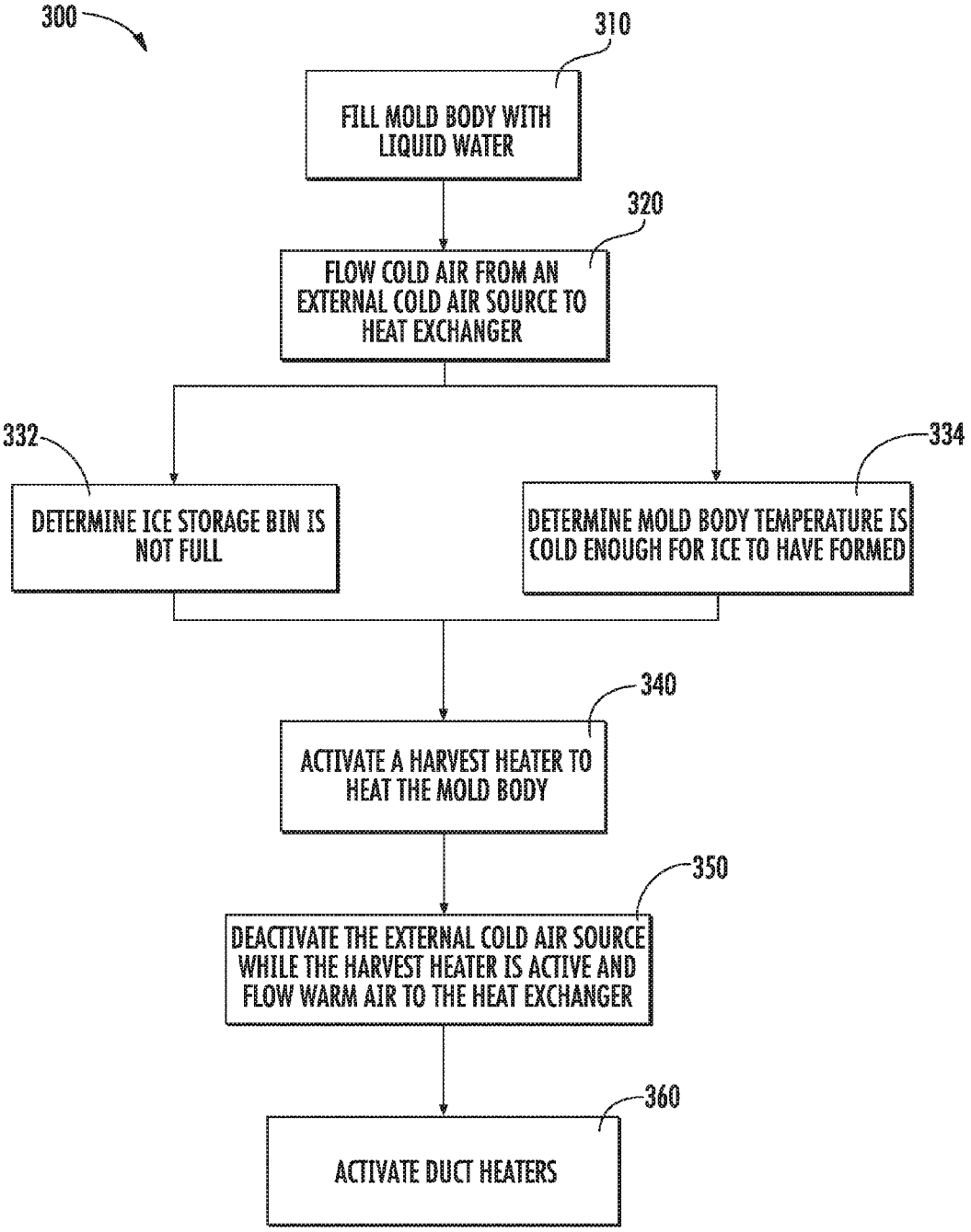
FIG. 7 provides a flowchart of a method of operating an ice making system according to an exemplary embodiment of the present subject matter.

FIG. 7 illustrates an exemplary method 300 of defrosting an ice maker 200 when the ice storage bin 204 is not full such that the ice maker 200 is in an ice making mode. Method 300 may be used with ice maker 200 disposed within refrigerator 100 as described herein, or may be used with other suitable ice makers. As illustrated for example in FIG. 7, method 300 may include actuating a valve 203 connected to a water supply line 201 to fill the mold body 210 with liquid water at step 310. Method 300 may also include activating a fan 180 to flow cold air from an external cold air source 170 (for example, the external cold air source may be a freezer evaporator 170 positioned proximate the freezer chamber 124) to the heat exchanger 206 at step 320. Method 300 may also include activating the harvest heater 214 to heat the mold body 210 at step 340. Further, method 300 may include deactivating the external cold air source 170, e.g., freezer evaporator 170, while the harvest heater 214 is active, such that the fan 180 flows warm air to the heat exchanger 206 at step 350. In some exemplary embodiments, deactivating the external cold air source 170 may further include deactivating compressor 14 (FIG. 4). When the ice maker 200 is in the ice making mode, ice in the mold body 210 may then be harvested therefrom and deposited in the ice storage bin 204.

In some exemplary embodiments, deactivating the external cold air source may include deactivating cooling system 10 such that refrigerant is not supplied to evaporator 170. In such embodiments, "warm" air may be at a temperature of between about zero degrees Fahrenheit (0° F.) and about ten degrees Fahrenheit (10° F.) when it leaves the freezer compartment 124, and between about ten degrees Fahrenheit (10° F.) and about twenty degrees Fahrenheit (20° F.) when it reaches the heat exchanger 206. It may also be possible in some exemplary embodiments to vary the speed of fan 180 to influence the temperature of the warm air. For example, running the fan 180 more slowly may allow the air to warm up more between the freezer compartment 124 and the heat exchanger 206, such that the warm air may be at a higher temperature, e.g., greater than about twenty degrees Fahrenheit (20° F.) when it reaches the heat exchanger 206. Such embodiments may be advantageous for ice storage mode, as described hereinbelow.

In some exemplary embodiments, the method 300 may further include the step 332 of determining with the level sensor 205 that the ice storage bin 204 is not full, e.g., by determining that a level of ice stored in the ice storage bin 204 is less than a full level, prior to activating the harvest heater 214 at step 340. Additionally, some exemplary embodiments of method 300 may also include sensing a temperature of the mold body 210 with temperature sensor 209 after activating the fan 180. Such exemplary embodiments may further include a step 334 of determining that the sensed temperature of the mold body is sufficiently low for ice to have formed in the mold body 210, prior to activating the harvest heater 214 at step 340. Further, it is also possible in some exemplary embodiments of method 300 to include a step 360 of activating a heater 173/177 (FIG. 3) disposed in a duct 172/178, the duct 172/178 extending between the heat exchanger 206 and the freezer evaporator 170.

Figure 8:
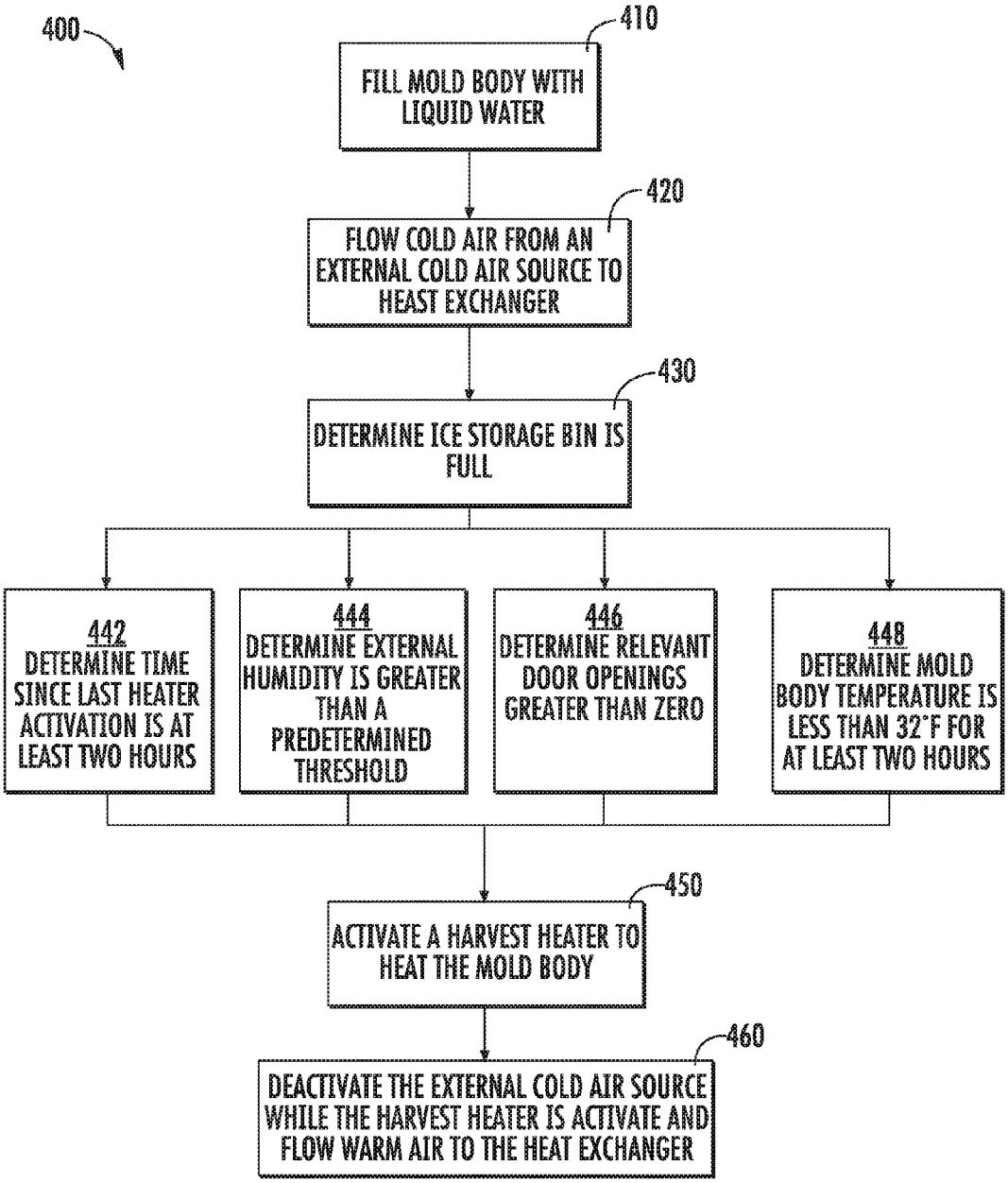
FIG. 8 provides a flowchart of a method of operating an ice making system according to an exemplary embodiment of the present subject matter.

Turning now to FIG. 8, some exemplary embodiments may include a method 400 of defrosting an icemaker, e.g., icemaker 200 disposed in sealed compartment 160. Method 400 may be used with ice maker 200 disposed within refrigerator 100 as described herein, or may be used with other suitable ice makers. The method 400 may include actuating a valve 203 connected to a water supply line 201 to fill the mold body 210 with liquid water at step 410. Method 400 may further include activating a fan 180 to flow cold air from an external cold air source 170 outside the sealed compartment 160 to the heat exchanger 206 at step 420. Method 400 may also include activating the harvest heater 214 to heat the mold body 210 at step 450. Method 400 may further include deactivating the external cold air source 170 while the harvest heater 214 is active, such that the fan 180 flows warm air to the heat exchanger 206 at step 460.

In some exemplary embodiments, the method 400 may further include the step 430 of determining with the level sensor 205 that the ice storage bin 204 is full, e.g., by determining that a level of ice stored in the ice storage bin 204 is at least a full level, prior to activating the harvest heater 214 at step 450. When the ice storage bin 204 is full, the ice maker 200 may be in an ice storage mode and the harvest heater 214 may be activated to defrost the mold body 210 and/or heat exchanger 206, without harvesting ice from the mold body 210.

In embodiments wherein ice is harvested from the mold body 210, e.g., the ice making mode, the harvest heater 214 may be deactivated when the harvest operation is complete. In other embodiments, e.g., when the ice storage bin 204 is full, the harvest heater 214 may be deactivated when it can be determined that defrosting of the ice maker 200 is complete or at least substantially complete. For example, some methods may include sensing the temperature of the mold body 210 with the temperature sensor 209 after activating the harvest heater 214 and deactivating the harvest heater 214 when the temperature is greater than about thirty-five degrees Fahrenheit.

In some exemplary embodiments, the method 400 may further include measuring a time since the harvest heater 214 was last activated. In such embodiments, the method 400 may also include tracking the number of times the door 126 has been opened since the harvest heater 214 was last activated by tracking the status of the switch 154 (FIG. 3). Method 400 may also include sensing a temperature of the mold body 210 with a temperature sensor 209 (FIG. 5) proximate to the mold body 210 after activating the fan 180. Further, method 400 may include sensing a humidity of an ambient environment outside of the refrigerator appliance 100 with the external humidity sensor 156. Thus, method 400 may include a defrost algorithm at steps 442, 444, 446, and/or 448, which may determine that defrosting is required based on time humidity, and/or temperature. In some embodiments, the defrost algorithm may determine that defrosting is required when the time since the harvest heater 214 was last activated is greater than about two hours at step 442. The defrost algorithm may also determine that defrosting is required when the sensed humidity is greater than a predetermined humidity threshold at step 444. The defrost algorithm may also determine that defrosting is required when the number of times the door 126 has been opened since the harvest heater 126 was last activated is greater than zero at step 446. The defrost algorithm may also determine that defrosting is required when the sensed temperature of the mold body 210 is less than about thirty-two degrees Fahrenheit at step 448. In such embodiments, the step 450 of activating the harvest heater 214 may be performed after determining that defrosting is required based on the defrost algorithm, where the defrost algorithm includes steps 442, 444, 446, and/or 448.

In some embodiments, the method may also include determining that the sensed temperature of the mold body 210 is about thirty-two degrees Fahrenheit, then monitoring the time since the sensed temperature of the mold body 210 reached about thirty-two degrees Fahrenheit while also monitoring the temperature of the mold body 210. That is, once the temperature of mold body 210 reaches about thirty-two degrees Fahrenheit, both time and temperature are monitored, e.g., as the temperature of the mold body 210 continues to decline. Monitoring the time and temperature may include sensing the temperature of the mold body 201 periodically after the sensed temperature of the mold body 210 is less than about thirty-two degrees Fahrenheit. For example, in some embodiments, the controller 134 may receive a sensed temperature of the mold body 210 from the thermistor 209 every second, and then when the sensed temperature reaches about thirty-two degrees Fahrenheit, the controller may then monitor both time and temperature, e.g., in degrees and seconds. Such exemplary embodiments thus may consider both time and temperature in determining that defrosting is required. Further, some exemplary embodiments include both the time below about thirty-two degrees Fahrenheit and the time since the last ice harvest. For example, some embodiments of method 400 may consider both time and temperature in the step 448, which may include determining that the temperature of the mold body 210 has been less than about thirty-two degrees Fahrenheit for at least two hours.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of defrosting an icemaker disposed in a sealed compartment of a refrigerator appliance, the refrigerator appliance comprising a cabinet defining a fresh food chamber and a freezer chamber, the freezer chamber positioned below the fresh food chamber along a vertical direction, the icemaker including a mold body, an ice storage bin disposed within the sealed compartment below the mold body, a level sensor proximate to a top portion of the ice storage bin, and a heat exchanger, the heat exchanger extending through the sealed compartment and in thermal communication with the mold body, the sealed compartment disposed outside of the freezer chamber and proximate to the fresh food chamber, the method comprising:

actuating a valve connected to a water supply line to fill the mold body with liquid water;

activating a fan to flow cold air to the heat exchanger from a freezer evaporator positioned proximate the freezer chamber;

determining with the level sensor that a level of ice stored in the ice storage bin is at least a full level;

determining that a time since the harvest heater was last activated is greater than about two hours prior to activating the harvest heater;

activating a harvest heater to heat the mold body after determining with the level sensor that the level of ice in the ice storage bin is at least the full level and determining that the time since the harvest heater was last activated is greater than about two hours prior to activating the harvest heater; and deactivating the freezer evaporator while the harvest heater is active, such that the fan flows warm air to the heat exchanger.

2. The method of claim 1, further comprising:

sensing a temperature of the mold body with a temperature sensor proximate to the mold body after activating the fan; and determining that the sensed temperature of the mold body is sufficiently low for ice to have formed in the mold body prior to activating the harvest heater.

3. The method of claim 1, further comprising activating a heater disposed in a duct, the duct extending between the heat exchanger and the freezer evaporator.

4. The method of claim 1, further comprising sensing a temperature of the mold body with a temperature sensor proximate to the mold body after activating the fan and determining that the sensed temperature of the mold body is less than about thirty-two degrees Fahrenheit, measuring a time that the sensed temperature of the mold body is less than about thirty-two degrees Fahrenheit, sensing the temperature of the mold body periodically after the sensed temperature of the mold body is less than about thirty-two degrees Fahrenheit, and determining that the measured time exceeds a predetermined amount and the periodically sensed temperature is less than a predetermined amount prior to activating the harvest heater.

5. The method of claim 1, wherein the refrigerator appliance further comprises a door rotatably hinged to the cabinet at the fresh food chamber, the door comprising an inner surface, the sealed compartment positioned at the inner surface of the door and a switch positioned such that the inner surface of the door engages the switch when the door is in a closed position, and wherein the method further comprises tracking a number of times the door has been opened since the harvest heater was last activated by tracking the status of the switch and determining that the number is greater than zero prior to activating the harvest heater.

6. The method of claim 1, wherein the refrigerator appliance further comprises an external humidity sensor, the method further comprising sensing a humidity of an ambient environment outside of the refrigerator appliance with the external humidity sensor and determining that the sensed humidity is greater than a predetermined humidity threshold prior to activating the harvest heater.

7. The method of claim 1, further comprising sensing a temperature of the mold body with a temperature sensor proximate to the mold body after activating the harvest heater and deactivating the harvest heater when the temperature is greater than about thirty-five degrees Fahrenheit.

8. A method of defrosting an icemaker disposed in a sealed compartment, the icemaker including a mold body and a heat exchanger extending through the sealed compartment, the heat exchanger in thermal communication with the mold body wherein the sealed compartment is positioned within a refrigerator appliance, the refrigerator appliance comprising a cabinet defining a fresh food chamber and a freezer chamber, the freezer chamber positioned below the fresh food chamber along a vertical direction, the sealed compartment disposed outside of the freezer chamber and proximate to the fresh food chamber, and the refrigerator appliance further comprises an external humidity sensor, a door rotatably hinged to the cabinet at the fresh food chamber, the door comprising an inner surface, the sealed compartment positioned at the inner surface of the door and a switch positioned such that the inner surface of the door engages the switch when the door is in a closed position, the method comprising:

actuating a valve connected to a water supply line to fill the mold body with liquid water;

activating a fan to flow cold air from a cold air source outside the sealed compartment to the heat exchanger;

activating a harvest heater to heat the mold body;

deactivating the cold air source while the harvest heater is active, such that the fan flows warm air to the heat exchanger;

measuring a time since the harvest heater was last activated;

tracking the number of times the door has been opened since the harvest heater was last activated by tracking the status of the switch;

sensing a temperature of the mold body with a temperature sensor proximate to the mold body after activating the fan;

sensing a humidity of an ambient environment outside of the refrigerator appliance with the external humidity sensor; and determining that defrosting is required when the time since the harvest heater was last activated is greater than about two hours, the number of times the door has been opened since the harvest heater was last activated is greater than zero, the sensed temperature of the mold body is less than about thirty-two degrees Fahrenheit, and the sensed humidity is greater than a predetermined humidity threshold;

wherein the step of activating the harvest heater is performed after determining that defrosting is required.

9. The method of claim 8, wherein the icemaker further comprises an ice storage bin disposed within the sealed compartment below the mold body and a level sensor proximate to a top portion of the ice storage bin, and the method further comprises determining with the level sensor that a level of ice stored in the ice storage bin is at least a full level prior to activating the harvest heater.

10. A refrigerator appliance, comprising:

a cabinet defining a fresh food chamber and a freezer chamber, the freezer chamber positioned below the fresh food chamber along a vertical direction, the cabinet also defining a sealed icebox compartment outside of the freezer chamber and proximate to the fresh food chamber, the sealed icebox compartment including a heat exchange opening;

an ice maker disposed within the sealed icebox compartment, the ice maker comprising a mold body and a heat exchanger, the heat exchanger extending through the sealed icebox compartment at the heat exchange opening and in thermal communication with the mold body;

an ice storage bin disposed within the sealed compartment below the mold body;

a level sensor proximate to a top portion of the ice storage bin;

an external humidity sensor;

a temperature sensor proximate to the mold body;

a door rotatably hinged to the cabinet at the fresh food chamber, the door comprising an inner surface, the sealed icebox compartment positioned at the inner surface of the door;

a switch positioned such that the inner surface of the door engages the switch when the door is in a closed position; and a controller, the controller configured to:

actuate a valve connected to a water supply line to fill the mold body with liquid water, activate a fan to flow cold air to the heat exchanger from a freezer evaporator positioned proximate the freezer chamber;

determine with the level sensor that a level of ice stored in the ice storage bin is at least a full level;

measure a time since the harvest heater was last activated;

sense a humidity of an ambient environment outside of the refrigerator appliance with the external humidity sensor;

receive a sensed temperature of the mold body from the temperature sensor;

determine that the sensed temperature of the mold body is less than about thirty-two degrees Fahrenheit;

measure a time that the sensed temperature of the mold body is less than about thirty-two degrees Fahrenheit;

track the number of times the door has been opened since the harvest heater was last activated by tracking the status of the switch;

determine that defrosting is required when the time since the harvest heater was last activated is greater than about two hours, the sensed humidity is greater than a predetermined humidity threshold, the time that the sensed temperature of the mold body is less than about thirty-two degrees Fahrenheit is greater than about two hours, and the number of times the door has been opened since the harvest heater was last activated is greater than zero;

activate a harvest heater to heat the mold body after determining with the level sensor that the level of ice stored in the ice storage bin is at least the full level and determining that defrosting is required; and deactivate the freezer evaporator while the harvest heater is active, such that the fan will flow warm air to the heat exchanger.

11. The refrigerator appliance of claim 10, wherein the controller is further configured to deactivate the harvest heater when the mold body temperature is greater than about thirty-five degrees Fahrenheit.

* * * * *